United States Patent [19]

Dunn et al.

[11] 4,430,924

[45] Feb. 14, 1984

[54] PETROLEUM PUMPING UNIT

[75] Inventors: Richard P. Dunn; Wilbur D. Garrels, both of Wichita Falls, Tex.

[73] Assignee: Hydrowell SA, Caracas, Venezuela

[21] Appl. No.: 297,261

[22] Filed: Aug. 28, 1981

[51] Int. Cl.[3] ..... F01L 25/08; F01B 15/00; F15B 13/06

[52] U.S. Cl. ..... 91/277; 91/275; 91/533; 92/118; 92/161; 74/590; 60/369

[58] Field of Search ..... 60/369, 370, 372; 74/110, 589, 590; 91/218, 533, 275, 178, 176, 196, 277; 92/118, 146, 161

[56] References Cited

U.S. PATENT DOCUMENTS

| | | | |
|---|---|---|---|
| 1,845,176 | 2/1932 | Palm | 91/338 |
| 2,073,809 | 3/1937 | Salentine | 91/274 |
| 2,268,945 | 1/1942 | Kelley | 74/110 |
| 2,644,307 | 7/1953 | Blair | 91/533 |
| 2,683,424 | 7/1954 | Kane | 417/399 |
| 3,128,675 | 4/1964 | Dulaney | 91/178 |
| 3,153,387 | 10/1964 | Sadoucet | 92/130 R |
| 3,535,985 | 10/1970 | Attebo | 92/137 |
| 3,777,491 | 12/1973 | Bender | 60/372 |
| 3,782,117 | 1/1974 | James | 60/372 |
| 3,971,213 | 7/1976 | Kelley | 91/218 |
| 4,114,375 | 9/1978 | Saruwatari | 60/372 |
| 4,201,115 | 5/1980 | Ogles | 60/369 |

*Primary Examiner*—Paul E. Maslousky

*Attorney, Agent, or Firm*—Sixbey, Friedman & Leedom

[57] ABSTRACT

A petroleum pumping unit which is especially suitable for use in remote oil fields and under unpredictable pumping conditions is disclosed. The petroleum pumping unit of the present invention, which is easily movable between a folded, collapsed position for storage and shipment and an erect position for pumping operations, includes a horizontal support platform on which is pivotally mounted a mast assembly including a pair of masts spaced outwardly from the centrally positioned well polish rod. The polish rod is engaged by a notch in a horizontal, vertically movable bridle and is powered by at least one pair of flexibly mounted hydraulic cylinders and associated piston rods attached to the bridle and positioned between the polish rod and the masts and parallel thereto. Vertical movement of the bridle and, therefore, the stroke of the polish rod is defined by upper and lower limit switches which are actuated by actuating means on the bridle. A counterweight support box which surrounds the masts and is vertically movable thereon is provided to assist the cylinders in powering the polish rod. Tapered weight brackets including diagonal projecting ridges engage notched counterweights which are held in place by gravity and prevented from contacting the mast by weight guards. The counterweight box may be eliminated and a plurality of spaced cylinders employed to power the polish rod.

33 Claims, 8 Drawing Figures

FIG. 6.
FIG. 2.
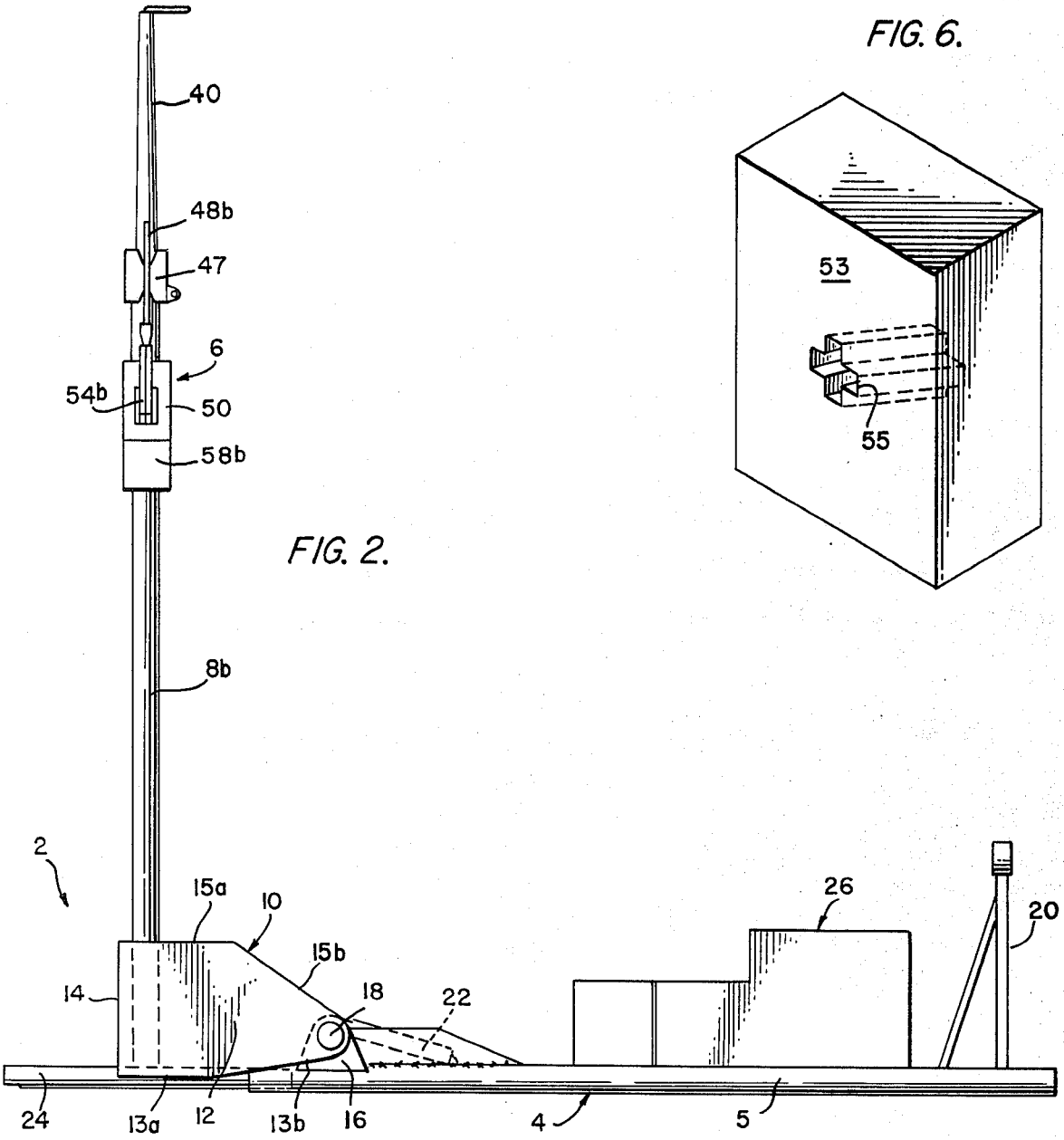
FIG. 3.
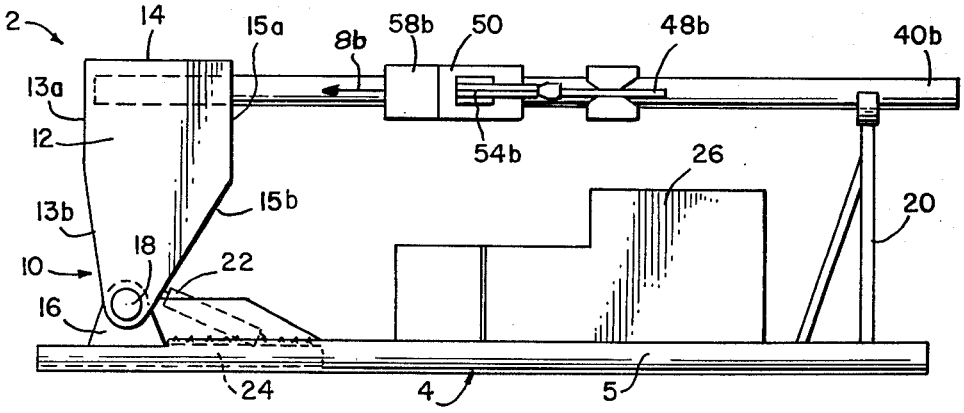

PETROLEUM PUMPING UNIT

TECHNICAL FIELD

The present invention relates generally to hydraulic powered pumping units and more particularly to an easily transported and erected, efficient hydraulic powered unit for pumping petroleum.

BACKGROUND ART

The demand for finding and exploiting sources of petroleum beyond those currently known and used has often required the drilling of oil wells in remote places. Once a well has been drilled, the pumping unit must be assembled and erected over the well head so that the oil can be pumped out of the well. When the well has been exhausted, which could happen after a relatively short time, or if the well is unproductive, the pumping unit must be disconnected, taken down and moved to a new well site. Therefore, efficient exploitation of these wells requires petroleum pumping units which may be easily transported, often over rough terrain, to the oil field and quickly erected over the well head without a large work crew. Additionally, an ideal unit for use under such conditions must be easily taken down, moved to a new well head site and re-erected with a minimal expenditure of time.

An ideal pumping unit must be versatile as well as easily transportable and erectable. Once a petroleum pumping unit is in place over the well head, conditions affecting the pumping operations will arise. For example, the viscosity of the oil may vary considerably from well to well or may even exhibit variation during pumping operations in a single well. As oil viscosity increases, resistance to pumping increases and the equipment is subjected to greater stress. Pumping equipment must be able to respond effectively and efficiently to such variations in oil viscosity if maximum exploitation of a well is to be achieved. In particular, excessive stress and strain on the well polish rod must be minimized, regardless of oil viscosity or other variable conditions encountered at a well site. In a remote oil field, a substantial period of time can be lost if a broken or bent polish rod has to be replaced.

Conventional oil well pumps of the walking beam of "horse head" type, like those disclosed in U.S. Pat. No. 3,513,387 to Sadouet, include many bulky, heavy parts which are difficult to transport and even more difficult to assemble and disassemble rapidly at the well head under conditions typically found in remote oil fields. Additionally, the stroke of these "horse head" pumps is limited by the length of the walking beam. An increase in the length of stroke is achieved by providing a single vertical mast which may be collapsible to facilitate shipment to the field, as disclosed in U.S. Pat. Nos. 3,535,985 to Attebo; 3,777,491 to Bender; 3,782,117 to James and 4,114,735 to Saruwautari. While the units disclosed in the aforementioned patents provide a longer stroke, are easier to ship and, in the case of the unit disclosed by Saruwautari, are easier to erect than the walking beam type pumps, these collapsible pumping units do not incorporate the versatility necessary to compensate for many variations in pumping conditions, such as oil viscosity variations. Additionally, in single mast units, the hydraulic cylinder and piston to operate the pump are located directly over the polish rod in axial alignment therewith, making it impossible to rapidly connect the pumping unit to polish rods which project at different heights above the well head. Furthermore, these single mast units are not always as stable as desired once they have been installed.

Pumping units known to the prior art which include structure to minimize strain on the well polish rod are disclosed in U.S. Pat. Nos. 1,845,176 to Palm, 2,073,809 to Salentine, 2,683,424 to Kane, and 3,153,387 to Sadouet. Most of these units employ a system of counterweights to assist in powering a single hydraulic cylinder during the up stroke to raise the polish rod. Counterbalancing the hydraulic cylinder effectively assists in raising the polish rod through viscous oil without rod damage. However, no simple means to easily change the counterweights on a hydraulic pumping unit are disclosed by the prior art.

Consequently, a need exists for a portable petroleum pumping unit which may be easily shipped and transported to remote oil fields, readily and quickly erected at the well head by a minimal work crew to form a very stable supporting structure for the pumping apparatus, and which includes features whereby the unit may be readily adapted to compensate for variations in pumping conditions and still function at optimum efficiency.

DISCLOSURE OF THE INVENTION

It is, a primary object of the present invention to provide a foldable petroleum pumping unit which is easily transported to a well site, erected to form a stable structure, and readied for pumping operations under a wide range of pumping conditions with a minimum expenditure of time and labor.

It is another object of the present invention to provide a petroleum pumping unit which is positioned at the well head so that the well polish rod is centrally positioned with respect to a pair of spaced vertical masts and a pair of vertical hydraulic cylinders and piston rods for driving the polish rod so that the well polish rod is maintained in substantial vertical alignment therewith.

It is an additional object of the present invention to provide a petroleum pumping unit which a vertically movable horizontal bridle which supports the lower ends of the piston rods and includes a central connection for engaging the well polish rod so that polish rods which extend above the well head for varying distances can be clamped to the bridle without interferring with the piston rods.

It is a further object of the present invention to provide a petroleum pumping unit wherein the well polish rod and the piston rods of the hydraulic cylinders driving the polish rod are connected to a horizontal bridle which is vertically movable between adjustable upper and lower limit points so that the length of the stroke can be adjusted as needed.

It is yet an additional object of the present invention to provide a petroleum pumping unit which has a pair of masts which can be folded back on a horizontal platform, and the distance between the masts corresponds to the distance between the supporting braces along the length of each side of the platform so that when the masts are moved to a vertical position, an extremely stable structure for performing pumping operations is formed.

It is yet another object of the present invention to provide a foldable, substantially L-shaped petroleum pumping unit which can be pivoted away from the well head to provide a cleared space free from obstruction by the pumping unit around the well head to facilitate servicing of equipment in the well.

It is still another object of the present invention to provide a petroleum pumping unit wherein the hydraulic cylinders are flexibly mounted in ball and socket trunions to minimize stresses on the cylinders and piston rods during pumping operations.

It is yet an additional object of the present invention to provide a petroleum pumping unit having a counterweight support box mounted for vertical movement on a pair of masts which supports weights used to assist the hydraulic system. The counterweight support box includes a pair of opposed tapered brackets on which the weights are hung so that they are held in place primarily by gravitational forces.

It is still another object of the present invention to provide a petroleum pumping unit which powers the centrally positioned well polish rod by a plurality of vertical hydraulic cylinders so that sufficient power is provided to drive the polish rod during a wide range of pumping conditions without the need for the counterweights.

Other objects and advantages will be apparent to those skilled in the art following a review of the following description, drawings and claims.

In accordance with the aforesaid objects, the present invention provides a petroleum pumping unit which has a pair of substantially vertical, spaced masts pivoted about a fulcrum positioned rearwardly with respect to the masts on the side opposite the well head. The fulcrum is supported by a substantially horizontal support platform so that the masts are movable between a collapsed or folded, horizontal position substantially parallel to the support platform for transport of the unit and an erect, vertical position substantially perpendicular to the support platform for pumping operations. The distance between the masts corresponds to the distance between the supporting braces along the length of each side of the platform. In the erect, vertical position, the masts are spaced outwardly on either side of a centrally positioned well polish rod, and at least one pair of hydraulic cylinders and their associated pistons rods are positioned on either side of the polish rod between the masts. The lower ends of the piston rods are connected to a horizontal bridle, which includes a central notch for engaging and clamping the polish rod. The bridle is mounted for vertical movement between a pair of vertical rails spaced inwardly from the masts. Attached to the bridle between the piston rods and the rails is a pair of weight cables which extend vertically upward from the bridle and over a pair of sheaves, one at the top of each mast, to support a counterweight support box. The counterweight support box has opposed tapered brackets for hanging removable weights which are held in place by gravity. Counterweights can be easily slipped on the brackets as needed to assist the cylinders in powering the polish rod. The cylinders are flexibly mounted within a horizontal cross member extending between the masts in ball and socket trunions. On one side of the bridle is an actuating arm for contacting vertically adjustable upper and lower limit switches which activate the hydraulic system when contacted to restrict the vertical movement of the bridle between predetermined upper and lower points along the mast. One or more hydraulic cylinders is associated with the fulcrum to raise the mast structure from a collapsed or folded position to an erect position. For added stability, the horizontal support platform is provided with a pair of telescoping extension braces, spaced to correspond to the distance between the masts, which extend in the direction of the well head perpendicular to the erect mast.

BRIEF DESCRIPTION OF THE DRAWINGS

FIG. 2 is a side view of the petroleum pumping unit of the present invention in the erect position;

FIG. 3 is a side view of the petroleum pumping unit of the present invention showing the unit in a folded position ready for shipment.

FIG. 6 is a front view of a counterweight to be used with the present invention;

BEST MODE FOR CARRYING OUT THE INVENTION

The petroleum pumping unit of the present invention is ideally suited for transport to remote oil fields where widely varying pumping conditions are likely to be encountered. As will be discussed in more detail hereinbelow, the unit folds back on a supporting platform to occupy minimal space during shipment, and, at the well head, erection of the unit to an extremely stable vertical position, connection to the well pumping equipment, and start up of the pumping unit can be performed by a small work crew in a very short time. Disconnecting the unit from the well and folding the unit back on the support platform for transporting the unit to a new well site can likewise be accomplished quite rapidly.

Figure 1:
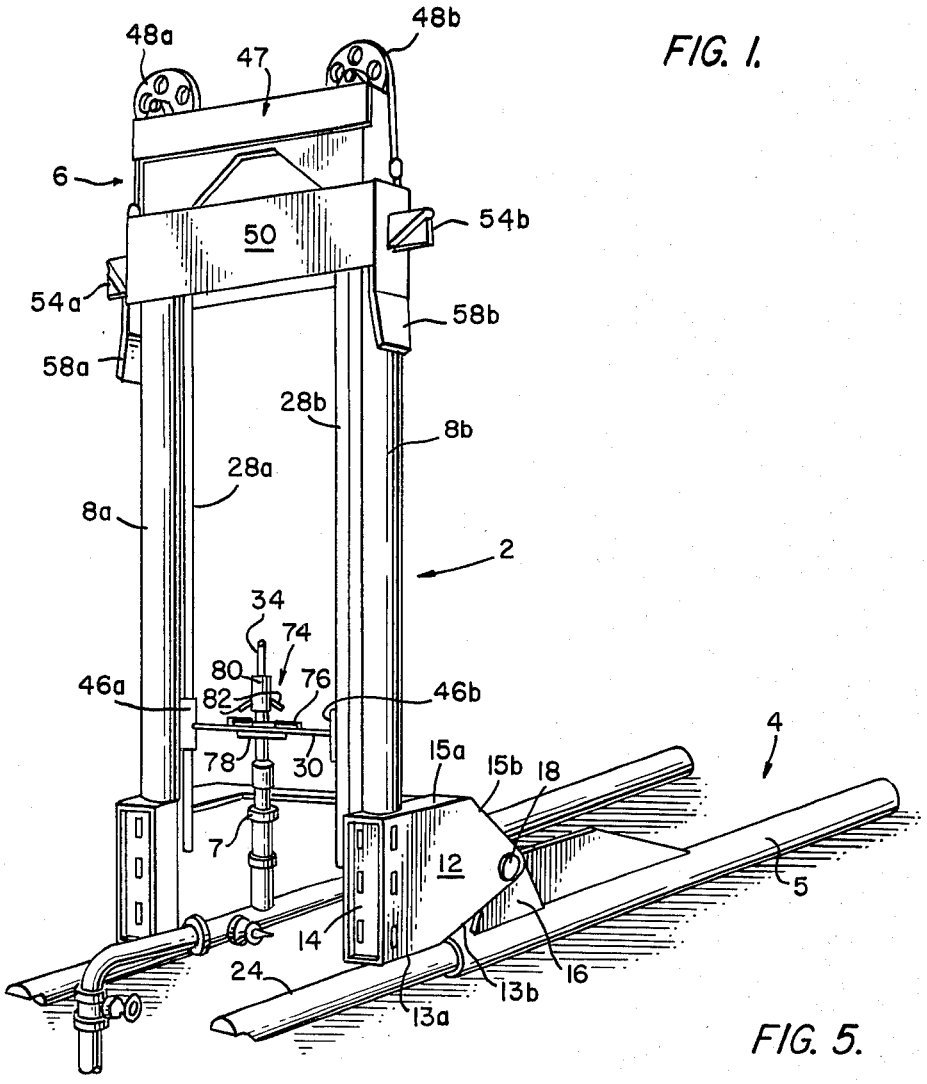
FIG. 1 is a front perspective of the petroleum pumping unit of the present invention operatively connected to an oil well.

Referring now to the drawings, FIG. 1 illustrates in front perspective the petroleum pumping unit 2 of the present invention in place at the well head. The relationship between horizontal support platform 4 and vertical mast assembly 6 imparts a stability to the present pumping unit which has not been achieved in prior art units. Support platform 4 includes parallel longitudinal braces 5 which extend along the length of each side of the platform from the well head end to the rear. The vertical mast assembly includes a pair of masts, 8*a* and 8*b*, which are spaced apart by a distance equal to the width of platform 4 between braces 5 so that the well head 7 and associated structures are equidistant between horizontal braces 5 and masts 8*a* and 8*b*. This arrangement is significantly more stable than the single mast pumping units currently employed for pumping petroleum. Additionally, the motor and components of the hydraulic system (shown in FIGS. 2 and 3) are positioned rearwardly on platform 4 from the mast assembly 6 to contribute further to the stability of the present pumping unit by concentrating the weight and bulk attributable to these structures opposite the heavy vertical mast assembly.

FIG. 2 illustrates the petroleum pumping unit 2 of the present invention as it appears from the side in an erect position at the well head. Braces 5 of horizontal support platform 4 typically rest on the ground. However, depending upon the conditions at the well site, they may be positioned slightly above the ground on beams, blocks or any other suitable supporting or leveling structure. At the well head, or front end of the platform 4, the vertical mast assembly 6 is supported over the well head perpendicular to the horizontal support platform. The vertical mast assembly 6 includes the pair of spaced parallel masts 8*a* and 8*b* which form an assembly 6 pivotally attached to platform 4 by a mast fulcrum assembly 10. The mast fulcrum assembly 10 includes a pair of mast support brackets 12 secured along end 14 in perpendicular relationship to the bottom of each mast section 8. The end of bracket 12 opposite end 14 is secured to a fulcrum bracket 16 on platform 4 by a rotating mast supporting shaft 18. Rotating shaft 18 allows movement of the entire vertical mast assembly 6 and the brackets 12 attached thereto about the axis formed by shaft 18 from the fully upright position shown in FIG. 2 to the fully collapsed position shown in FIG. 3. Support 20 is provided opposite mast assembly 6 on platform 4 to engage and support the upper part of the mast assembly when the mast asembly is in the collapsed position. Vertical mast structure 6 may be pivoted from an upright to a collapsed positon on shaft 18 by the action of one or more hydraulic cylinders 22.

The configuration of brackets 12 shown in FIGS. 1, 2 and 3 has been found to enhance the stability of the vertical mast structure 6 in the upright, erect position of FIGS. 1 and 2 during operation of the pumping unit. Bracket 12 is attached to the mast along the entire length of side 14. The bottom edge of bracket 12 includes a short section 13*a* which is substantially perpendicular to side 14 and a long section 13*b* which is tapered upward from its intersection with side 14 toward fulcrum bracket 16. When the mast assembly 6 is pivoted about shaft 18 away from the well (FIG. 3) so that section 13*a* is substantially perpendicular to platform 4, this shape provides maximum clearance around the well for maintenance and repairs. The top edge of bracket 12 includes section 15*a* which is substantially perpendicular to side 14 and section 15*b* which is tapered downward toward fulcrum bracket 16. To enhance further the stability of the pumping unit in the upright position of FIG. 2, a pair of platform extension arms 24 are provided which extend forwardly beyond the well head. Arms 24 are preferably telescoped into braces 5 as shown to reduce manufacturing costs as well as to provide a more compact unit for shipment. Additionally, if the pumping equipment in the well requires servicing, the vertical mast assembly 6 may be pivoted about shaft 18 to its collapsed position and arms 24 retracted into braces 5 to provide an unobstructed area around the well head which greatly facilitates performance of any repairs or maintenace.

Platform 4 also supports the motors and hydraulic equipment, shown in block at 26 in FIGS. 2 and 3, required to operate the pumping unit and to activate hydraulic cylinder 22. This equipment operates to weight down the platform 4 and provide a stable base for the mast assembly 6.

Figure 4:
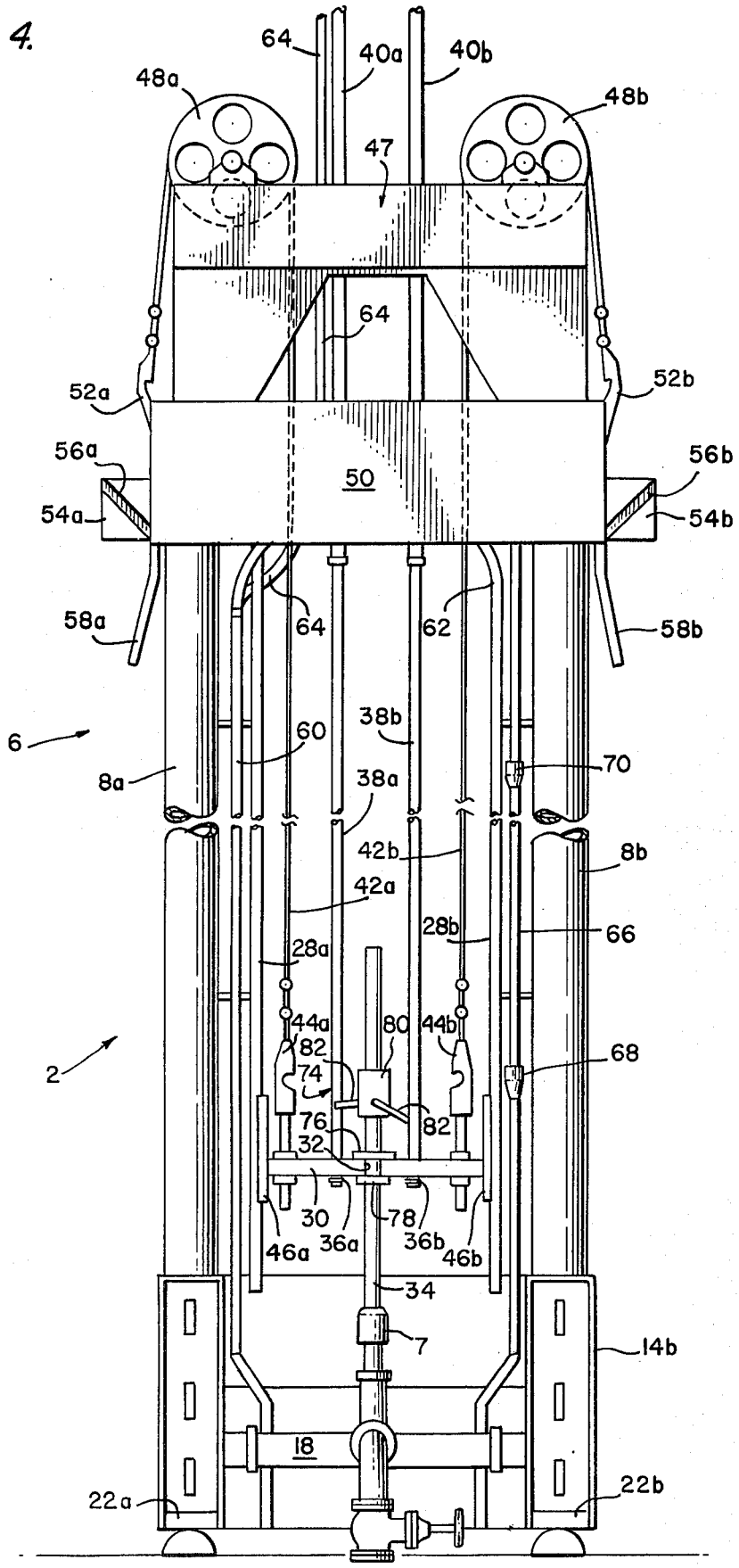
FIG. 4 is a front view of the petroleum pumping unit of the present invention erected over the head of an oil well.

FIG. 4 is a view of the pumping unit 2 of the present invention as it appears from the front or well head side of the unit. Masts 8*a* and 8*b* of the vertical mast assembly 6 are parallel and spaced apart a distance selected to provide the necessary stability to the unit and to accommodate all the required vertical structures necessary for efficient operation of the unit without sacrificing the unit's overall compactness. As discussed hereinabove, this distance corresponds to the width of the support platform between braces 5. Secured to and spaced inwardly from masts 8*a* and 8*b* are a pair of rails 28*a* and 28*b* on which is mounted a horizontal bridle 30 for vertical movement along the rails. Bridle 30 includes central notch 32 for receiving the well polish rod 34, which extends out of the well head 7. Bridle 30 is attached to the bottom ends 36*a* and 36*b* of a pair of parallel piston rods 38*a* and 38*b* which are disposed within a pair of conventional hydraulic cylinders 40*a* and 40*b* and spaced outwardly equidistant from the polish rod toward rails 28*a* and 28*b*. A pair of cables 42*a* and 42*b* is secured to bridle 30 outwardly from the piston rods 38*a* and 38*b* by attachments 44*a* and 44*b*, which may be any attachments of the type conventionally used to secure cables. Bridle 30 further includes at the outer edges a pair of vertically extending arms 46*a* and 46*b* which are fitted into tracks in rails 28*a* and 28*b*, as will be described in more detail hereinbelow, so that bridle 30 is guided for vertical movement between the rails.

Figure 5:
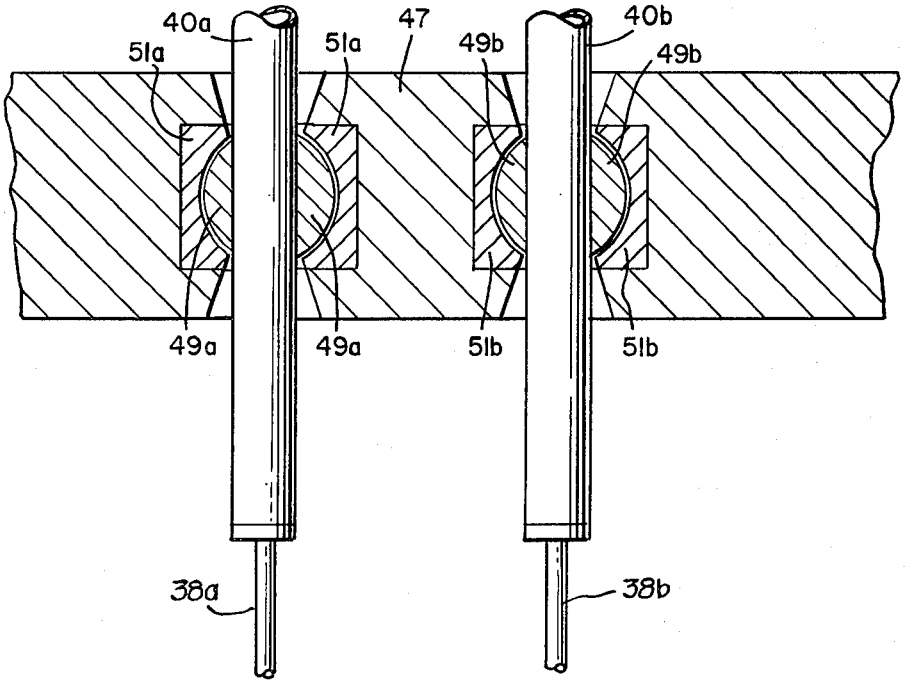
FIG. 5 is a front cross-sectional view of the cylinder mounting assembly of the present invention.

Piston rods 38*a* and 38*b* are disposed within parallel hydraulic cylinders 40*a* and 40*b* and may extend a considerable distance above the vertical mast assembly 6 in order to accomodate the length piston rod required to provide sufficient stroke for the pumping unit. The cylinders are mounted within bridge 47 which extends horizontally between masts 8. FIG. 5 illustrates the cylinder mountings.

The pumping unit of the present invention is completely symmetrical on both sides of the polish rod to avoid any pull on or cocking of the piston rods. During pumping, the polish rod is often likely to be deflected from a position in perfect axial alignment with the piston rods and cylinders. When this happens, if the cylinders are rigidly mounted and unable to give, too much drag is put on one side and the polish rod is likely to bend, cocking the piston rod so that it is not properly aligned with the cylinder. The piston rod then moves up and down against the cylinder seal, causing it to wear and, ultimately, to leak and fail, resulting in the shutdown of pumping operations. To overcome this problem, the cylinders in the present pumping unit are mounted for limited universal movement in joints which provide limited movement of the cylinders in response to deflection of the polish rod during pumping. Ball members 49*a* and 49*b* are externally secured to the cylinders 40*a* and 40*b*. Ball members 49*a* and 49*b* are engaged by correspondingly shaped socket members 51*a* and 51*b* so that the cylinders have about 15° movement in all directions. Socket members 51*a* and 51*b* are mounted on bridge 47 which extends between the masts 8*a* and 8*b*.

Bridge 47 supports a pair of shallow groove sheaves 48*a* and 48*b* which receive cables 42*a* and 42*b*. Cables 42*a* and 42*b* extend vertically from attachments 44*a* and 44*b* on bridle 30 parallel to and between piston rods 38*a* and 38*b* and rails 28*a* and 28*b* and over sheaves 48*a* and 48*b* and are attached to a substantially rectangular counterweight support box 50, which surrounds the masts and is movable vertically along the masts. These cables are shown fastened to projections 52*a* and 52*b* on opposite sides of counterweight support box 50 by conventional cable attachments. However, cables 42*a* and 42*b* may be fastened to counterweight support box 50 by any conventional fastening means.

Counterweight support box 50 includes a pair of opposed, substantially square tapered brackets 54*a* and 54*b* on the sides of the box beyond masts 8. Each tapered bracket 54*a* and 54*b* is provided on both sides with a corresponding projecting ridge 56*a* and 56*b* extending from the upper, outer corner away from the mast to the lower, inner corner next to the mast. Notched, substantially rectangular counterweights 53, such as the one shown in FIG. 6, are slipped on the tapered brackets 54*a* and 54*b* so that the notches 55 engage projecting ridges 56*a* and 56*b*. Each weight slides downward on the bracket toward the mast, leaving room for additional weights. Gravitational forces pull the weights downward and hold them securely in place. The configuration of notches 55 conforms to the shape of the tapered brackets and the projecting ridges and permits the counterweights to be easily hung on and removed from the counterweight support box as needed. To prevent the weights from contacting masts 8*a* and 8*b* and thus interferring with the vertical movement of counterweight support box 50 along the masts, counterweight box 50 is provided with downwardly depending weight guards 58*a* and 58*b*. Counterweight box 50 also includes removable pins (not shown) to secure this structure in place on the mast assembly during shipment.

Hydraulic lines 60, 62 and 64 are supported by vertical mast assembly 6 and extend from cylinders 40*a* and 40*b* to conventional hydraulic pumps and associated equipment (shown at 26 in FIGS. 2 and 3) on support platform 4.

The vertical movement of bridle 30 is limited between predetermined upper and lower points by adjustable limit switches positioned along a vertical guide 66 supported on the mast assembly 6 parallel to one of the bridle guide rails. The distance selected between upper limit switch 70 and lower limit switch 68 will most likely vary from well to well and is dependent upon the desired pump stroke length. The shorter the distance between switches 68 and 70 is, the shorter the pump stroke length will be. Additionally, the limit switches may be reset as needed during pumping operations in the same well.

Figure 7:
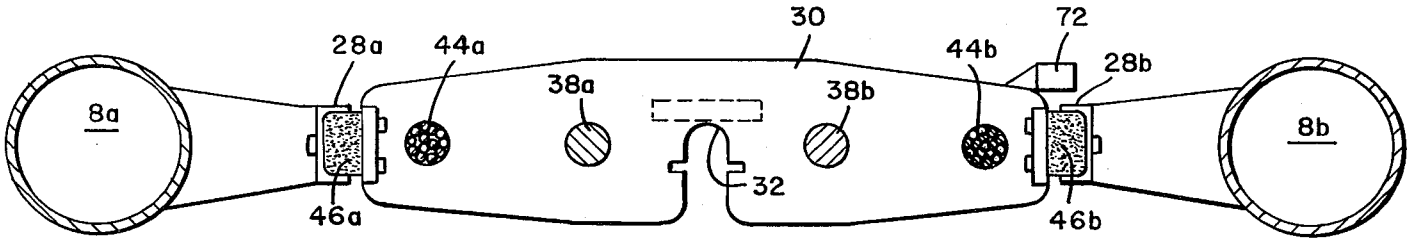
FIG. 7 is a top cross-sectional view of the bridle structure of the present invention taken along line 6—6 of FIG. 4.

Switch actuating arm 72 on bridle 30, shown in FIG. 7, is positioned to contact and actuate the limit switches 68 or 70 which, in turn, activates the hydraulic system as will be described in more detail hereinbelow. FIG. 7 further illustrates the engagement of bridle arms 46*a* and 46*b* in tracks in rails 28*a* and 28*b* to permit the vertical movement of bridle 30. Other engaging relationships between arms 46*a* and 46*b* and rails 28*a* and 28*b* which allow vertical movement of bridle 30 may also be employed.

In preparation for pumping operations, once the mast assembly 6 is in the vertical, erect position, well polish rod 34 is fitted into central notch 32 in bridle 30 and secured with a clamp assembly 74, which may be a three part assembly as shown in FIGS. 1 and 4, or which may be selected from other known clamp assemblies. The assembly shown includes horizontal plates 76 and 78 which have holes (not shown) for receiving the well polish rod. Plate 76 is positioned above and plate 78 is positioned below bridle 30. Clamp assembly 74 further includes stop 80 which is removably mounted on the polish rod slightly above bridle 30 when rod 34 is in its lowermost position as shown in FIGS. 1 and 4. Projections 82 contact the upper surface of bridle 30 to raise the polish rod with the bridle.

Figure 8:
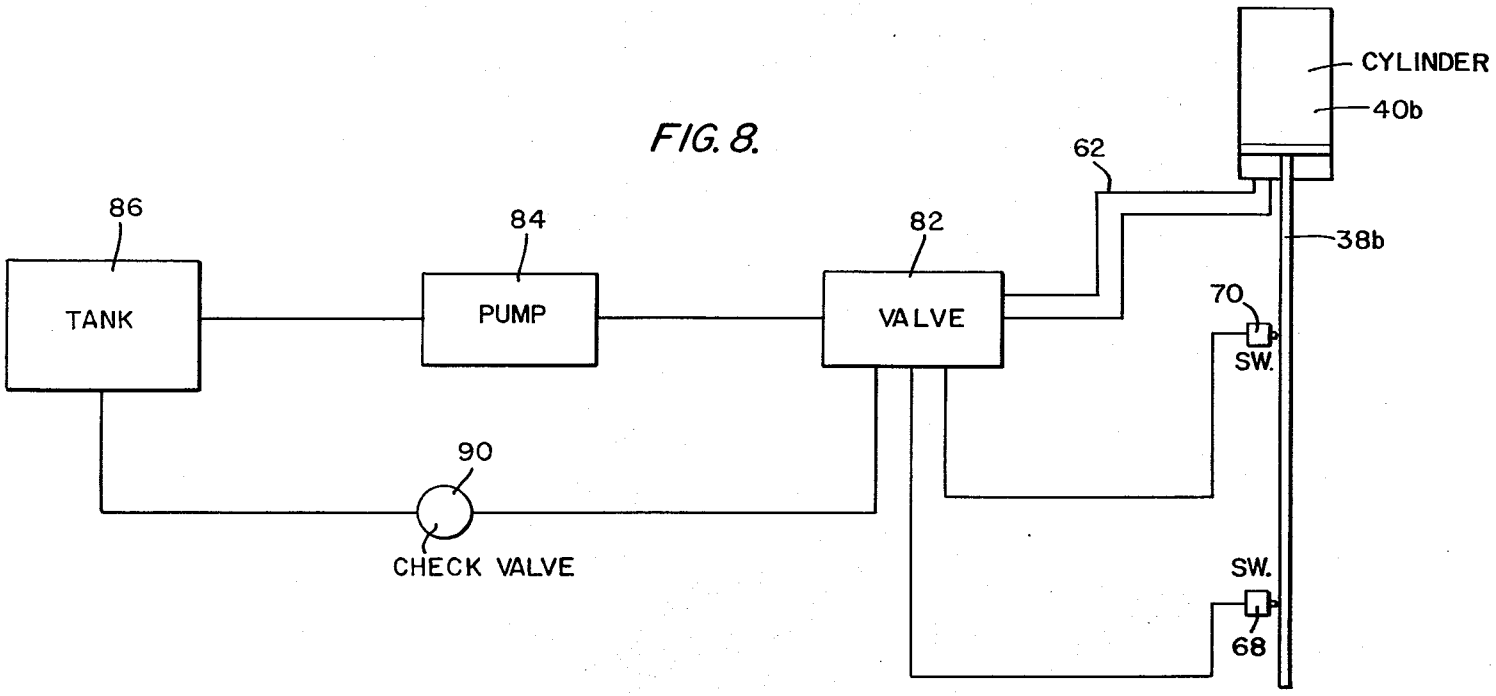
FIG. 8 is a schematic diagram of the hydraulic system of the present invention.

The operation of the pumping unit of the present invention will be discussed in connection with FIG. 8 which shows a schematic diagram of the hydraulic system of the pumping unit. Only one cylinder, 40*b*, is shown in FIG. 8. However, in actuality, the hydraulic system would include at least a pair of cylinders. The unit is typically started on the up stroke. To commence pumping, actuator arm 72 on bridle 30 must contact lower limit switch 68, which opens valve 82 and permits pump 84 to pump hydraulic fluid from tank 86 through hydraulic line 62 into the bottom of cylinder 40*b* to raise piston rod 38*b*. Piston rod 38*a*, although not shown in FIG. 8, is also being raised simultaneously. As the piston rods are pushed upward into the cylinders by the hydraulic fluid, the bridle 30 and the attached well polish rod are pulled upwardly. Fluid will continue to be pumped into cylinder 40*b* until the actuator arm 72 on bridle 30 contacts the upper limit switch 70. Switch 70 closes valve 82 and vents the cylinder to the tank 86, causing fluid to flow out of the cylinder and the piston rod 38*b* to fall. This has the effect of lowering bridle 30 and polish rod 34 downwardly into the well. Preferably, the weight of the polish rod and attached structures is permitted to pull the piston down, thus eliminating strain on the polish rod caused by pushing the piston rod down which occurs when hydraulic fluid is supplied to the top of the cylinder. The speed of the down stroke may be adjusted to a rate slower than that achieved solely by gravitational forces by placing a check valve 90 in the line between the cylinder and the tank. This enables the operator of the pumping unit to regulate the speed of the down stroke and, therefore, the force with which the polish rod travels downward. For example, a slow down stroke would be preferred for use with thin, low viscosity oil to prevent the polish rod from traveling downward at high speeds that could damage the rod and attached structures. Consequently, the pumping unit of the present invention may be readily adjusted to compensate for changes in drilling conditions which may vary significantly during pumping operations both in a single well and from well to well to achieve optimum efficiency of the unit. The control of piston rod speed possible with the present pumping unit insures that the polish rod will decelerate smoothly at the end of each stroke and then accelerate into the next stroke, which further enhances the unit's efficiency. Additionally, because the cylinder pulls the polish rod rather than pushes it, a long stroke can be achieved with smaller rod sizing than is possible with heretofore known units, and concern over rod deflection is virtually eliminated. Other, conventional, means such as, for example, changing pump sizes, cam ring sizes and swash plate settings may also be utilized to vary the flow rate of the hydraulic fluid and, thus, the polish rod travel speed.

Frequently, the power supplied by the hydraulic pistons and cylinders alone is insufficient to move the well polish rod efficiently. Therefore, counterweights such as the one shown in FIG. 6 may be added to the present pumping unit to assist in driving the pump. The weights are hung on tapered brackets 54*a* and 54*b* on vertically movable counterweight support box 50. This additional weight helps lift bridle 30 and, consequently, polish rod 34 by causing counterweight box 50 to move downward. The desired number of counterweights are easily slipped on brackets 54 and then removed therefrom as required for efficient operation of the polish rod. The need for counterweights may be completely eliminated, however, by providing additional cylinders. Two, three or more pairs of cylinders may be mounted in universal joints in support assembly 47 parallel to cylinders 40*a* and 40*b*.

Since counterweight box support 50 completely encloses the masts and structures positioned inwardly from the masts, it enhances the stability of the mast assembly, particularly during movement from a collapsed to an upright position.

Additional versatility is imparted to the present pumping unit by the employment of notch 32 in vertically movable bridle 30. It is often impossible to know in advance how far the well polish rod will extend above the well head. Therefore, prior art pumping units having fixed clamps for engaging the polish rod are often erected over the well head with the result that the polish rod extends beyond the level of the clamp or does not extend up far enough to engage the clamp. Once the present pumping unit is in place over the well head, the bridle 30 is moved upward or downward as needed and the polish rod 34 is slipped into notch 32 and clamped by plates 76 and 78 and assembly 80 as shown in FIGS. 1 and 4 or by other clamping means known to those skilled in the art.

The pumping unit of the present invention may be transported to the well head in the compact, folded condition shown in FIG. 3. Shipment will most likely be by flatbed truck or rail car; however, platform 4 could be provided with retractable or otherwise removable wheels and pulled as a trailer. The unit is positioned at the well head, the telescoping arms are extended and positioned to stabilize the platform, and the hydraulic cylinders are activated to raise the mast assembly. The polish rod is then clamped to the bridle, the weight box is raised and freed from its pins to travel up and down the mast structure, and counterweights are added as needed. Next, the proper pump stroke is set by adjusting the positions of the upper and lower limit switches, and the unit is ready for operation. Once transported to the well head site, the pumping unit of the present invention may be ready to begin pumping in about fifteen minutes. Disconnection of the unit and folding it to a collapsed position may be accomplished with the same facility.

INDUSTRIAL APPLICABILITY

The petroleum pumping unit of the present invention is ideally suited for use in remote oil fields where large work crews are usually unavailable to erect and monitor oil field pumping equipment. Additionally, the versatility of the present unit permits its adaptation to a wide range of variation in petroleum pumping conditions.

We claim:

1. A petroleum pumping unit for attachment to the well polish rod of a well head comprising: support means, a fulcrum assembly positioned on said support means, a mast assembly means attached to and movable about said fulcrum assembly between a first, folded position substantially parallel to said support means and a second, erect position substantially perpendicular to said support means, said mast assembly means including a pair of elongated, spaced masts, polish rod bridle means mounted on said mast assembly means for reciprocal movement between said masts in a direction substantially perpendicular to the longitudinal axis of said support means when said mast assembly means is in the second erect position, said polish rod bridle means including attachment means for attaching the well polish rod to said polish rod bridle means and at least first and second driving means secured to said polish rod bridle means for moving said bridle means between said masts, said first and second driving means mounted in limited universal movement mounting means between said masts and secured to said polish rod bridle means on opposite sides of said attachment means in spaced relationship thereto.

2. The petroleum pumping unit described in claim 1, wherein said driving means operates to drive said bridle in only one direction, said direction being away from said fulcrum assembly.

3. The petroleum pumping unit described in claim 1, wherein each said driving means includes a hydraulic cylinder and a piston rod, said cylinder being mounted adjacent the top of said mast assembly means and said piston rod extending away from the top of said mast assembly means toward said bridle means.

4. A petroleum pumping unit for attachment to the well polish rod of a well head comprising: support means, a fulcrum assembly positioned on said support means, a mast assembly means attached to and movable about said fulcrum assembly between a first, folded position substantially parallel to said support means and a second, erect position substantially perpendicular to said support means, said mast assembly means including a pair of elongated, spaced masts, polish rod bridle means mounted on said mast assembly for reciprocal movement between said masts in a direction substantially perpendicular to the longitudinal axis of said support means when said mast assembly is in the second erect position, said polish rod bridle means including attachment means for attaching the well polish rod to said polish rod bridle means and at least first and second driving means secured to said polish rod bridle means for moving said bridle means between said masts, said first and second driving means being mounted between said masts and secured to said polish rod bridle means on opposite sides of said attachment means and in spaced relationship thereto; wherein each said driving means includes a hydraulic cylinder and a piston rod, said cylinder being mounted adjacent the top of said mast assembly means and said piston rod extending away from the top of said mast assembly means toward said bridle means, and wherein said mast assembly means includes mounting means for mounting said hydraulic cylinder for limited universal movement.

5. The petroleum pumping unit described in claim 4, wherein said driving means operates to drive said bridle means in only one direction, said direction being away from said fulcrum assembly.

6. A petroleum pumping unit for attachment to the well polish rod of a well head comprising: support means, a fulcrum assembly positioned on said support means, a mast assembly means attached to and movable about said fulcrum assembly between a first, folded position substantially parallel to said support means and a second, erect position substantially perpendicular to said support means, said mast assembly means including a pair of elongated, spaced masts, polish rod bridle means mounted on said mast assembly for reciprocal movement between said masts in a direction substantially perpendicular to the longitudinal axis of said support means when said mast assembly is in the second erect position, said polish rod bridle means including attachment means for attaching the well polish rod to said polish rod bridle means and at least first and second driving means secured to said polish rod bridle means for moving said bridle means between said masts, said first and second driving means being mounted between said masts and secured to said polish rod bridle means on opposite sides of said attachment means and in spaced relationship thereto; wherein each said driving means includes a hydraulic cylinder and a piston rod, said cylinder being mounted adjacent the top of said mast assembly means and said piston rod extending away from the top of said mast assembly means toward said bridle means, said pumping unit further including counterweight support means, said counterweight support means being shaped to enclose said mast assembly means within the confines thereof and being reciprocably movable along said mast assembly means.

7. The petroleum pumping unit described in claim 6, wherein first and second cables are each attached at one end to opposite sides of said counterweight support means and at the opposite end to said bridle means on opposite sides of said attachment means and in spaced relationship thereto.

8. The petroleum pumping unit described in claim 1, wherein said mast assembly means includes bridle movement limiting means mounted on said mast assembly means to define the limits of movement of said bridle means between said masts.

9. The petroleum pumping unit described in claim 8, wherein said bridle movement limiting means is adjustable so that the limits of movement of said bridle means may be varied.

10. The petroleum pumping unit described in claim 9, wherein said bridle movement limiting means includes first and second limit switches, said first limit switch being positioned to limit the movement of said bridle means toward said fulcrum assembly and said second limit switch being positioned to limit the movement of said bridle means away from said fulcrum assembly.

11. The petroleum pumping unit described in claim 8, including counterweight support means for supporting one or more counterweights, wherein said counterweight support means includes opposed laterally extending weight hanger means, said weight hanger means including weight engaging means for removably engaging one or more counterweights.

12. The petroleum pumping unit described in claim 11, wherein said weight engaging means includes a pair of opposed projecting ridges extending diagonally across said weight hanger means toward said mast so that said counterweights are engaged by said projecting ridges and are caused to slide along said projecting ridges toward said mast.

13. The petroleum pumping unit of claim 12 wherein said counterweights include an opening shaped to correspond to the cross-sectional configuration of said weight hanger means and said weight engaging means.

14. A petroleum pumping unit for attachment to the well polish rod of a well head comprising: support means, a fulcrum assembly positioned on said support means, a mast assembly means attached to and movable about said fulcrum assembly between a first, folded position substantially parallel to said support means and a second, erect position substantially perpendicular to said support means, said mast assembly means including a pair of elongated, spaced masts, polish rod bridle means mounted on said mast assembly for reciprocal movement between said masts in a direction substantially perpendicular to the longitudinal axis of said support means when said mast assembly is in the second erect position, said polish rod bridle means including attachment means for attaching the well polish rod to said polish rod bridle means and at least first and second driving means secured to said polish rod bridle means for moving said bridle means between said masts, said first and second driving means being mounted between said masts and secured to said polish rod bridle means on opposite sides of said attachment means and in spaced relationship thereto, wherein said fulcrum assembly includes mast bracket means, fulcrum bracket means, and rotatable shaft means, said mast bracket means being attached to said mast assembly means, said fulcrum bracket means being attached to said support means, and said mast bracket means being pivotally attached to said fulcrum bracket means by said rotatable shaft means; said mast bracket means including a first side perpendicular to said mast and attached thereto, a second side subjacent to said first side, said second side including a first portion perpendicular to said first side and a second portion, a third side opposite said second side, said third side including a first portion perpendicular to said first side and a second portion, said second portion of said second side being directed toward said second portion of said third side and connecting therewith to form a curved portion about said rotatable shaft means so that when said mast assembly means is in said first folded position said first portion of said second side forms a flat surface substantially perpendicular to said support means.

15. The petroleum unit described in claim 8, wherein said bridle means includes actuating means for contacting and actuating said bridle movement limiting means.

16. The petroleum pumping unit described in claim 10, wherein said bridle means includes actuating means for contacting and actuating said first and second limit switches.

17. The petroleum pumping unit described in claim 4, wherein said mast assembly means includes bridle movement limiting means mounted on said mast assembly means to define the limits of movement of said bridle means between said masts.

18. The petroleum pumping unit described in claim 17, wherein said bridle movement limiting means includes adjustable first and second limit switches, said first limit switch being movable on said mast assembly means to limit the movement of said bridle means toward said fulcrum assembly, and said second limit switch being movable on said mast assembly means to limit the movement of said bridle means away from said fulcrum assembly.

19. The petroleum pumping unit described in claim 18, wherein said bridle means includes actuating means for contacting and actuating said first and second limit switches.

20. The petroleum pumping unit described in claim 19, including hydraulic fluid supply means for providing hydraulic fluid to said cylinder and exhausting hydraulic fluid from said cylinder, said hydraulic fluid supply means including a conduit connected to said cylinder, a supply of hydraulic fluid and pump means for pumping said fluid through said conduit to said cylinder, said conduit including disposed therein control means for controlling the flow of fluid through said conduit, said limit switch means being connected to said control means so that actuation of said first limit switch by said actuating means on the bridle means causes hydraulic fluid to flow into said cylinder and actuation of said second limit switch means causes fluid to flow out of said cylinder.

21. The petroleum pumping unit described in claim 20, wherein said driving means further includes counterweight support means movably mounted on said mast assembly means and shaped to enclose said mast assembly means within the confines thereof and being reciprocably movable along said mast assembly means.

22. The petroleum pumping unit described in claim 1, wherein said support means includes a pair of spaced, substantially parallel elongated braces, said braces being aligned with said masts and spaced apart by a distance substantially equal to the distance between said masts, said support means further including platform means extending between said braces, said braces including at one end thereof a pair of extension arm means mounted within said braces for telescoping movement therein, and said platform means including at the end opposite said extension arm means support means for supporting said mast assembly means when said mast assembly means is in said first, folded position.

23. The petroleum pumping unit described in claim 21, wherein said fulcrum assembly is positioned close to one end of said support means so that when said mast assembly means is in said second, erect position, said mast assembly means forms a right angle with said one end of said support means and said petroleum pumping unit has the configuration of a letter L.

24. The petroleum pumping unit described in claim 23, wherein said support means includes a pair of spaced, substantially parallel elongated braces, said braces being aligned with said masts and spaced apart a distance substantially equal to the distance between said masts, said support means further including platform means extending between said braces, said braces including at said one end of said support means a pair of extension arm means mounted within said braces for telescoping movement therein, and said platform means including at the end opposite said extension arm means support means for supporting said mast assembly means when said mast assembly means is in said first, folded position.

25. The petroleum pumping unit described in claim 24, wherein said counterweight support means includes opposed lateral weight hanger means, said weight hanger means including weight engaging means for removably engaging one or more counterweights, said weight engaging means including a pair of projecting ridges extending diagonally across said weight hanger means toward said mast.

26. The petroleum pumping unit described in claim 25, wherein said conduit is connected to said cylinder at the bottom thereof so that said piston rod is pushed upward as said cylinder is filled with hydraulic fluid.

27. The petroleum pumping unit described in claim 26, wherein said conduit includes flow restriction means for restricting the flow of hydraulic fluid flowing out of said cylinder.

28. The petroleum pumping unit described in claim 13, wherein said counterweight support means includes weight guard means for maintaining said counterweights at a spaced distance away from said masts.

29. The petroleum pumping unit described in claim 28, wherein said weight guard means includes a pair of opposed, downwardly depending plates attached to said counterweight support means below said weight hanger means and substantially in alignment with said masts.

30. The petroleum pumping unit described in claim 25, wherein said counterweight support means includes weight guard means for maintaining said counterweights at a spaced distance away from said masts.

31. A petroleum pumping unit for attachment to the well polish rod of a well head comprising: support means including a pair of spaced, parallel longitudinal braces including a platform extending therebetween, a fulcrum assembly positioned on said platform, a mast assembly means attached to and movable about said fulcrum assembly between a first, folded position substantially parallel to said braces and said platform and a second, erect position substantially perpendicular to said braces and said platform, said mast assembly means including a pair of elongated, spaced masts, polish rod bridle means mounted on said mast assembly means for reciprocal movement between said masts in a direction substantially perpendicular to said longitudinal braces when said mast assembly means is in the second, erect position, bridle movement limiting means for limiting the extent of said reciprocal movement of said polish rod bridle means, said polish rod bridle means including attachment means for attaching the well polish rod to said polish rod bridle means and first and second driving means secured to said polish rod bridle means for moving said bridle means between said masts, said driving means including hydraulic cylinders and piston rods, said cylinders being mounted between said masts for limited universal movement and said piston rods being secured to said polish rod bridle means on opposite sides of said attachment means and in spaced relationship thereto, said mast assembly means including mounted thereabout for reciprocating movement counterweight support means, said counterweight support means being secured to said polish rod bridle means on opposite sides of said piston rods and in spaced relationship thereto.

32. A petroleum pumping unit for attachment to the well polish rod of a well head comprising: support means, a fulcrum assembly positioned on said support means, a mast assembly means attached to and movable about said fulcrum assembly between a first, folded position substantially parallel to said support means and a second, erect position substantially perpendicular to said support means, said mast assembly means including a pair of elongated, spaced masts, polish rod bridle means mounted on said mast assembly for reciprocal movement between said masts in a direction substantially perpendicular to the longitudinal axis of said support means when said mast assembly is in the second erect position, said polish rod bridle means including attachment means for attaching the polish rod to said polish rod bridle means and a plurality of paired driving means secured to said polish rod bridle means for moving said bridle means between said masts, said plurality of driving means being mounted between said masts inside said mast assembly means for limited universal movement and secured to said polish rod bridle means on opposite sides of said attachment means and in symmetrical spaced relationship thereto.

33. The petroleum pumping unit described in claim 32, wherein said plurality of paired driving means includes hydraulic cylinders and piston rods, said cylinders being mounted adjacent the top of said mast assembly means and said rods extending away from the top of said mast assembly means toward said bridle means.

* * * * *